US006240570B1

(12) United States Patent
Wu

(10) Patent No.: US 6,240,570 B1
(45) Date of Patent: Jun. 5, 2001

(54) PROTECTIVE HAT FOR AN INFANT

(76) Inventor: Shih-Hsiung Wu, No. 26, Lane 90, Chung-Hsiao Road, Luo-Tung Township, I-Lan Hsien (TW)

( * ) Notice: Subject to any disclaimer, the term of this patent is extended or adjusted under 35 U.S.C. 154(b) by 0 days.

(21) Appl. No.: 09/633,647

(22) Filed: Aug. 7, 2000

(51) Int. Cl.[7] ..... A42B 1/06
(52) U.S. Cl. ..... 2/410; 2/411; 2/413; 2/DIG. 1
(58) Field of Search ..... 2/421, 410, 411, 2/413, 414, 175.4, 195.1, 195.5, DIG. 1

(56) References Cited

U.S. PATENT DOCUMENTS 2,422,116 * 6/1947 Mauro .
3,197,784 * 8/1965 Carlisle .
3,457,563 * 7/1969 Marchello .
4,345,336 * 8/1982 Plastino ..... 2/414 X
4,354,284 * 10/1982 Gooding ..... 2/413
4,434,513 * 3/1984 Welch ..... 2/410
4,581,773 * 4/1986 Cunnane ..... 2/411 X
4,776,324 * 10/1988 Clarren ..... 128/76 R
4,845,786 * 7/1989 Chiarella ..... 2/412
5,075,903 * 12/1991 Richoux ..... 2/411
5,289,591 * 3/1994 Andersen ..... 2/411
5,481,759 * 1/1996 Rinaldi ..... 2/195.1
5,606,744 * 3/1997 Lindy ..... 2/410
5,615,419 * 4/1997 Williams ..... 2/411
5,729,830 * 3/1998 Luhtala ..... 2/195.1 X
5,887,289 * 3/1999 Theoret ..... 2/411 X

* cited by examiner

*Primary Examiner*—Rodney Lindsey
(74) *Attorney, Agent, or Firm*—Harrison & Egbert

(57) ABSTRACT

A protective hat is designed to protect the head of an infant and is formed of a shell and a jacket fitted over the shell. The shell has a projecting front brim, two projecting side brims corresponding in location to the ears of an infant, and a number of ventilation holes. The jacket is formed of an inner layer, an outer layer, and a space located between the inner layer and the outer layer for receiving the shell. The jacket is provided with a chin strap and a zipper to facilitate the fitting of the jacket over the shell and the removing of the jacket from the shell.

6 Claims, 7 Drawing Sheets

PROTECTIVE HAT FOR AN INFANT

BACKGROUND OF THE INVENTION

1. Field of the Invention

The present invention relates generally to a protective hat, and more particularly to a protective hat for an infant.

2. Description of Related Art

In light of the poor baby balance and coordination, an infant is apt to fall to inflict a wound on himself or herself while learning to walk. The head of the infant is most vulnerable to injury at the time when the infant falls. The conventional infant hats are ornamentally designed and devoid of safety features for protecting the head of the infant.

BRIEF SUMMARY OF THE INVENTION

The primary objective of the present invention is to provide an infant's hat with decorative, protective, and soothing features.

The infant's hat of the present invention comprises mainly a shell and a jacket fitted over the shell. The shell is provided with a number of ventilation holes. The jacket is made of a breathable cloth.

The features and the advantages of the present invention will be more readily understood upon a thoughtful deliberation of the following detailed description of the present invention with reference to the accompanying drawings.

DETAILED DESCRIPTION OF THE INVENTION

As shown in FIGS. 1–5, a protective hat embodied in the present invention is designed for use in protecting the head of an infant and is formed of a shell 11 and a jacket 21.

Figure 5:
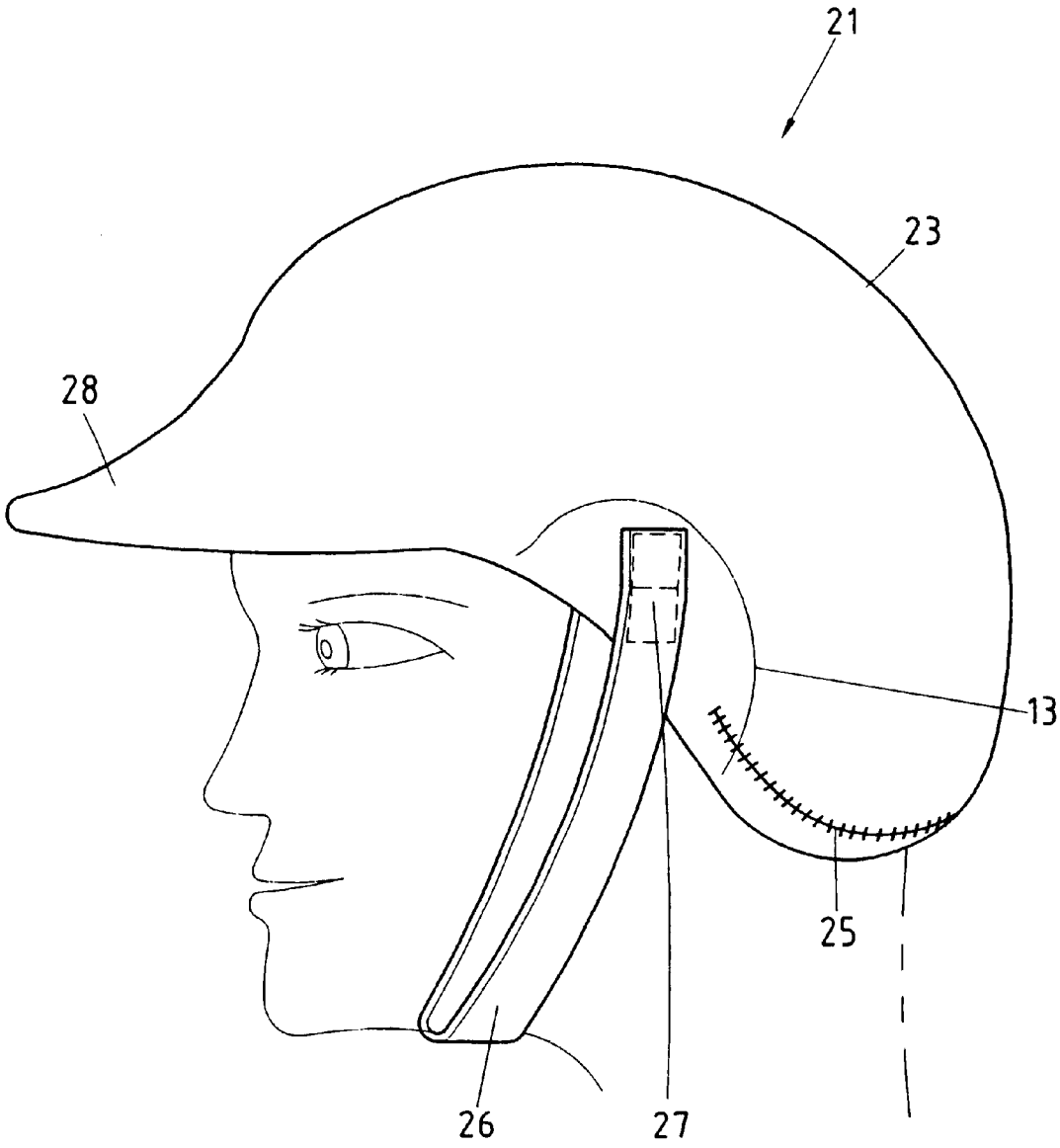
FIG. 5 shows a schematic view of the present invention in use.

The shell 11 is shaped to fit the head of an infant and is integrally made of a foam material, such as polyurethane (PU), ethylene vinyl acetate (EVA), expanded polystyrene (PS), or the like. The shell 11 has a projecting front brim 12, two projecting side brims 13 corresponding in location to the ears of an infant, and a number of ventilation holes 14. The shell 11 provides its user with protection against impact, as illustrated in FIG. 5.

Figure 1:
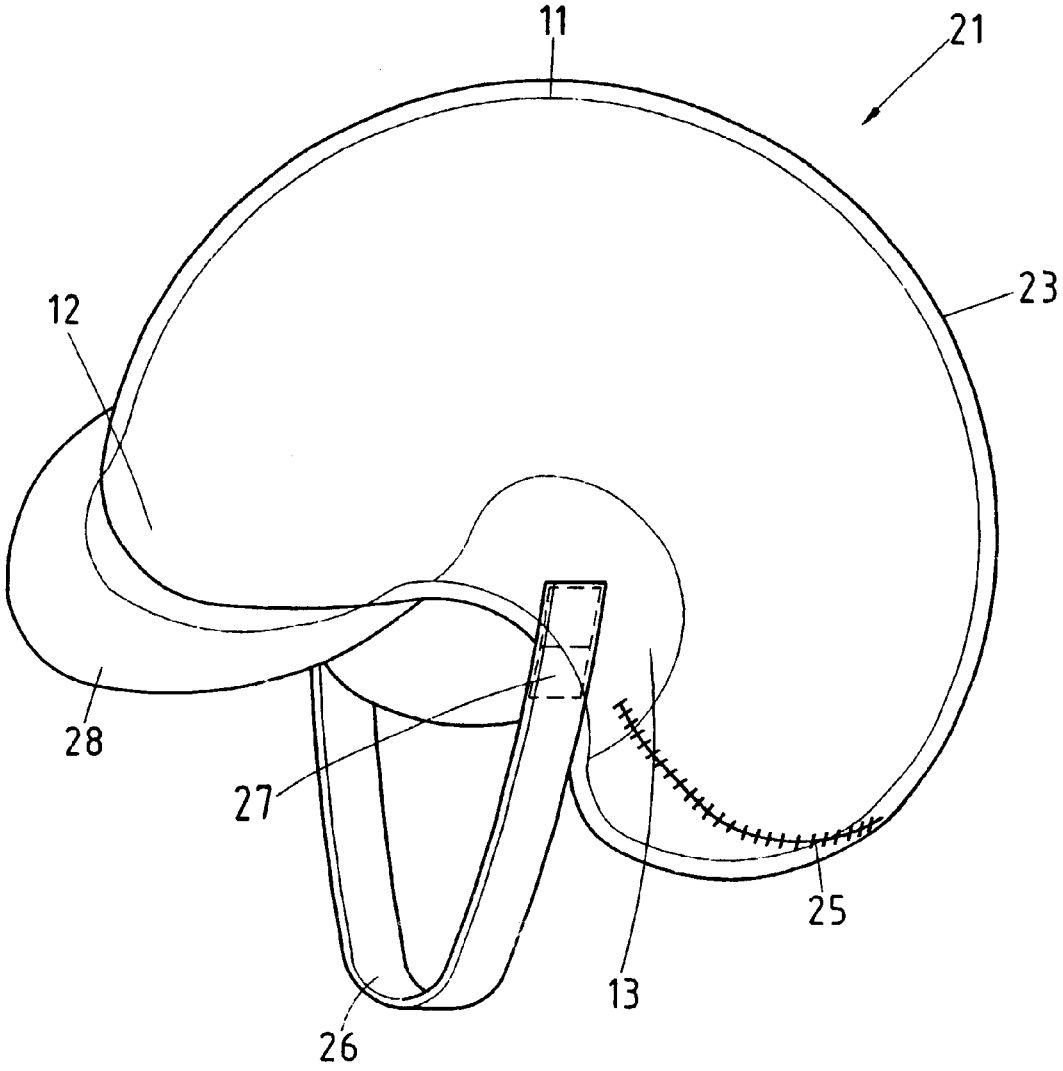
FIG. 1 shows a perspective view of the present invention.
Figure 2:
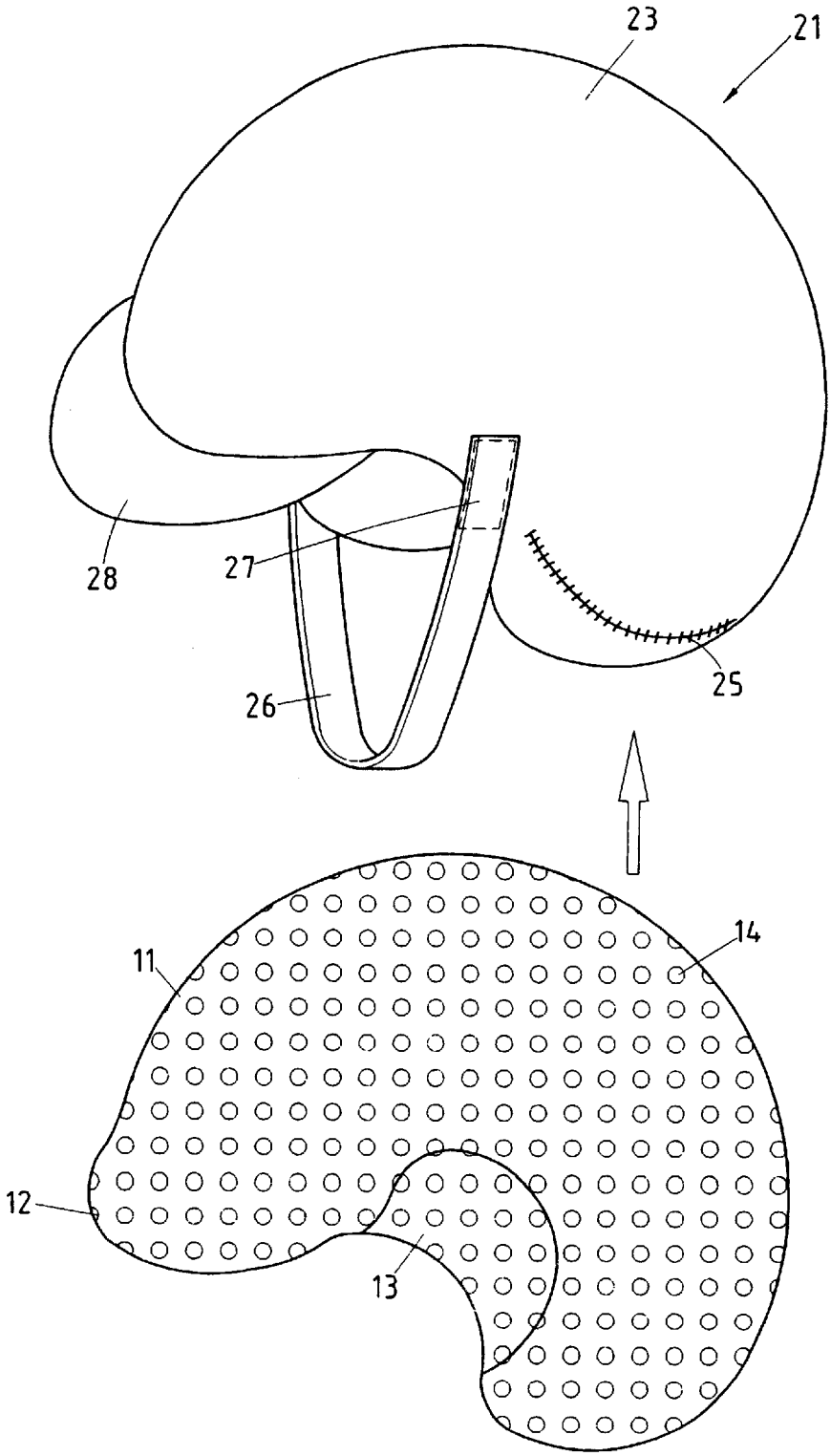
FIG. 2 shows an exploded view of the present invention.
Figure 3:
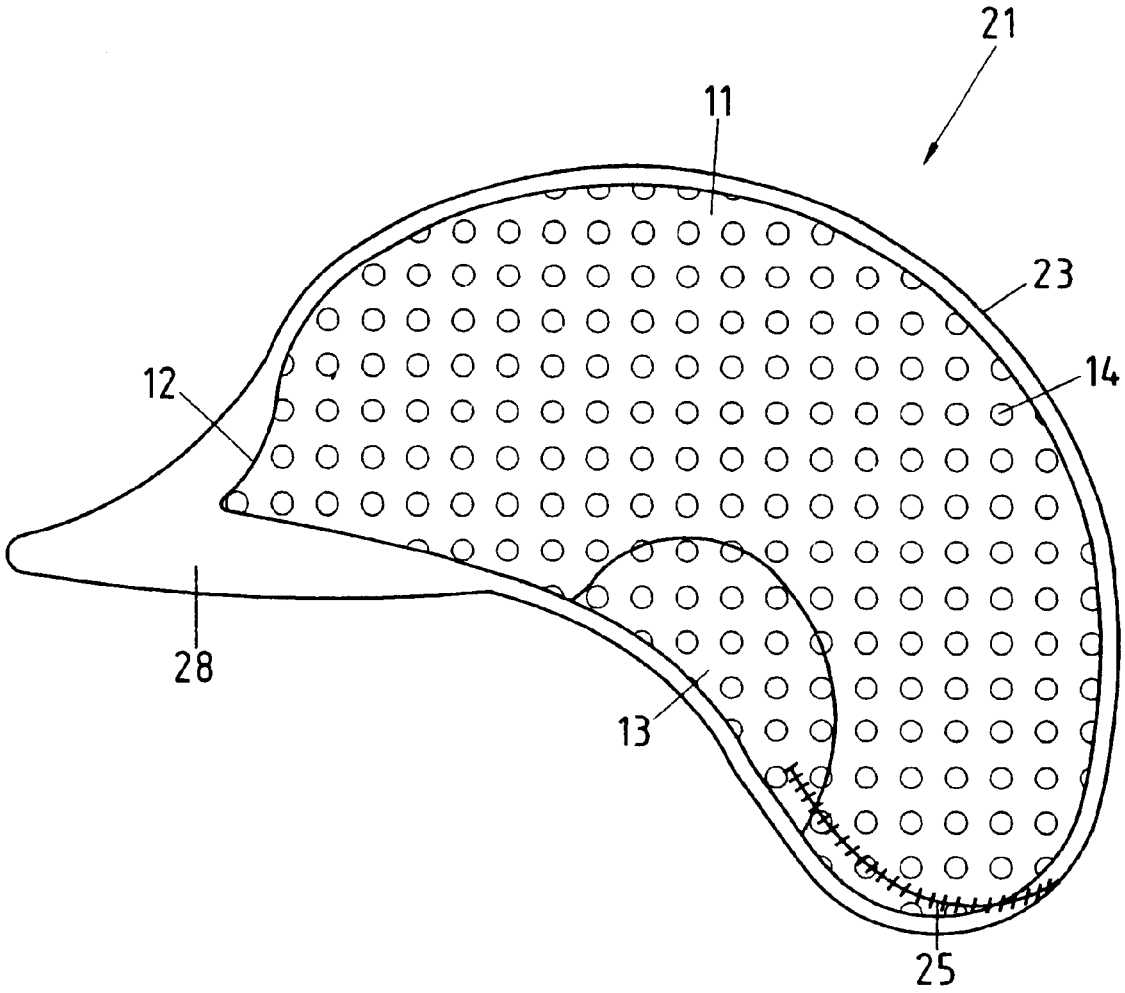
FIG. 3 shows a sectional view of the present invention in combination.
Figure 4:
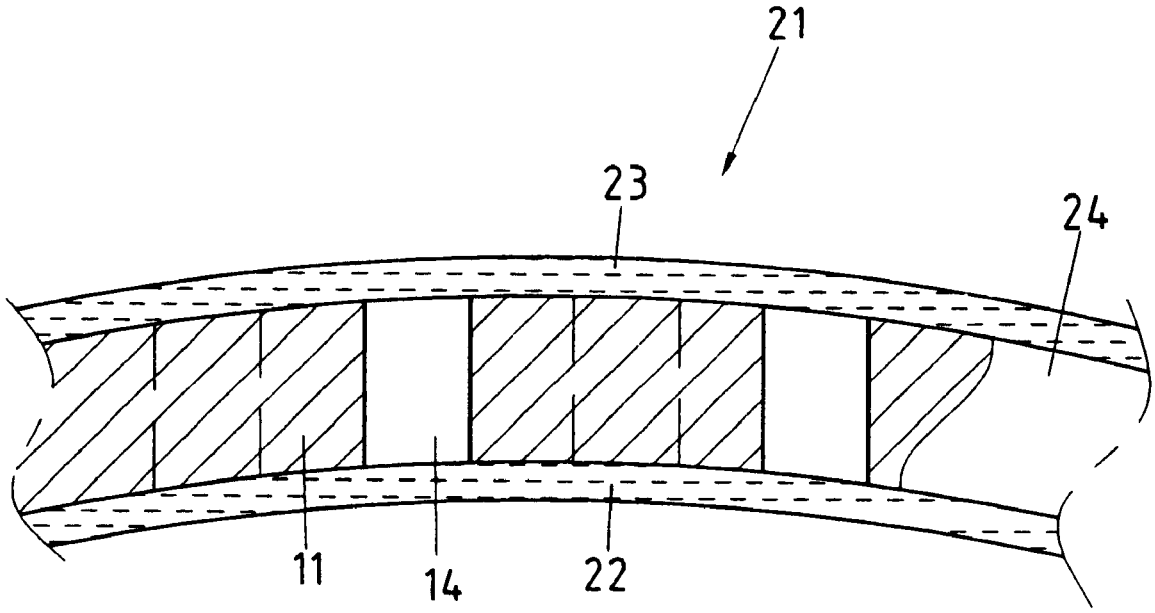
FIG. 4 shows a partial sectional view of the present invention.

The jacket 21 is fitted over the shell 11 for providing the shell 11 with decoration and is made of a breathable cloth. As shown in FIG. 4, the cross section of the jacket 21 is formed of an inner layer 22, an outer layer 23, and a space 24 sandwiched between the inner layer 22 and the outer layer 23. The jacket 21 is provided with a zipper 25 to facilitate the fitting of the jacket 21 over the shell 11 and the removing of the jacket 21 from the shell 11. The jacket 21 is further provided with a chin strap 26, which may be an elastic strap or a strap having the Velcro device (magic tape) for easy fastening and unfastening. The jacket 21 is further provided with a visor 28 which is shaped and sized to fit over the projecting front brim 12 of the shell 11. The shell 11 is received in the space 24 of the jacket 21.

Figure 6:
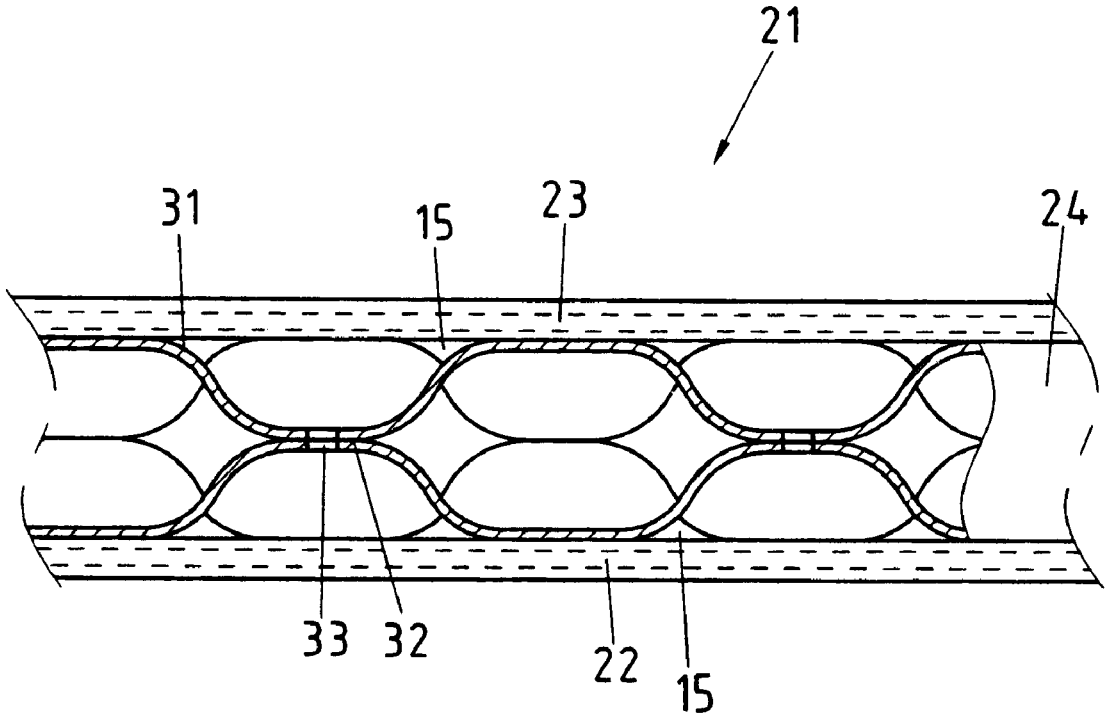
FIG. 6 shows another partial sectional view of the present invention.
Figure 7:
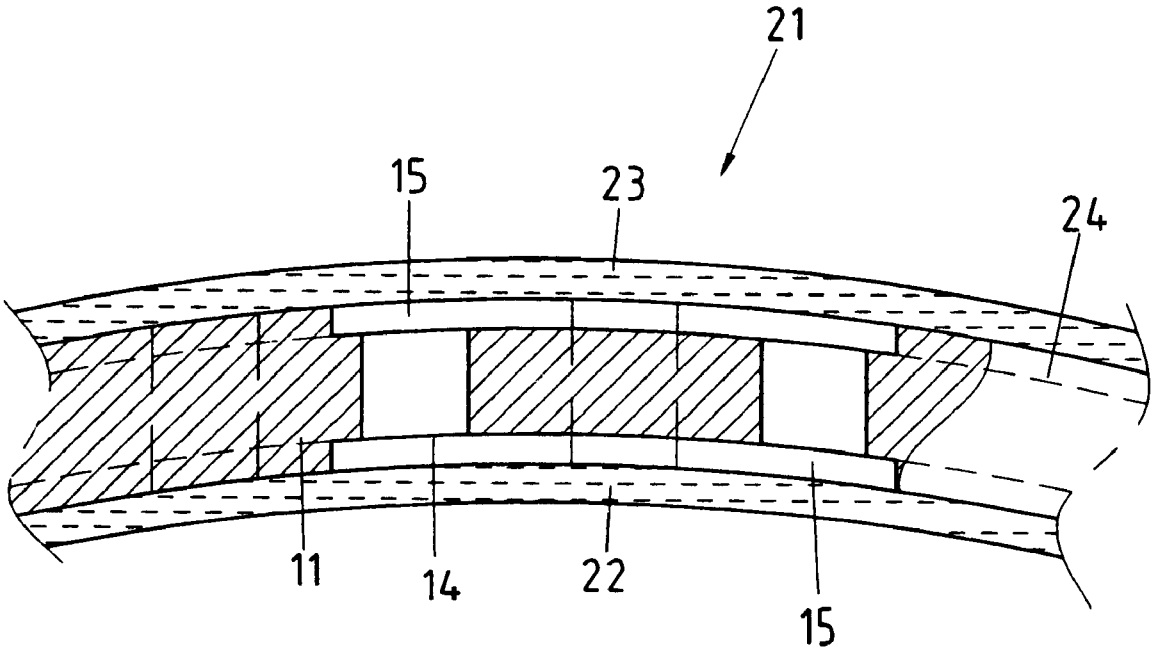
FIG. 7 shows still another partial sectional view of the present invention.

As shown in FIGS. 6 and 7, the shell 11 is replaced by an air sac 31 which is shaped like the head of an infant by a plurality of recesses 32. The shell 11 and the air sac 31 are provided with a plurality of ventilation slots 15 to facilitate the aeration in conjunction with the through holes 33.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

I claim:

1. A protective hat for an infant comprising:

a shell shaped to fit a head of the infant, said shell being of unitary construction and integrally formed of a material selected from the group consisting of polyurethane, ethylene vinyl acetate and expanded polystyrene, said shell having an outwardly projecting front brim and two outwardly projecting side brims, said side brims corresponding in locating to respective ears of the infant, said shell having a plurality of ventilation holes extending therethrough; and a jacket removably fitted over said shell, said jacket formed of a breathable cloth material, said jacket having an inner layer and outer layer, said jacket having a space between said inner layer and said outer layer, said shell being received in said space so as to be isolated from direct contact with the head of the infant, said jacket having a chin strap extending outwardly therefrom.

2. The protective hat as defined in claim 1, wherein said chin strap is an elastic strap.

3. The protective hat as defined in claim 1, wherein said chin strap has a hook-and-loop fastener secured to said jacket.

4. The protective hat as defined in claim 1, wherein said jacket is provided with a visor shaped to fit over said front brim of said shell.

5. The protective hat as defined in claim 1, wherein said jacket is provided with a zipper affixed thereto, said zipper openable to facilitate fitting of said jacket over said shell and removing of said jacket from said shell.

6. The protective hat as defined in claim 1, wherein said shell is an air sack having a plurality of recesses.

* * * * *